US005117894A

United States Patent [19]

Katahira

[11] Patent Number: 5,117,894

[45] Date of Patent: Jun. 2, 1992

[54] DIE CASTING METHOD AND DIE CASTING MACHINE

[76] Inventor: Yoshinori Katahira, No. 1170, Nippa-Cho, Kouhoku-Ku, Yokohama-shi, Japan

[21] Appl. No.: 689,349

[22] Filed: Apr. 22, 1991

[30] Foreign Application Priority Data

Apr. 23, 1990 [JP] Japan ..... 2-106919

[51] Int. Cl.[5] ..... B22D 29/00

[52] U.S. Cl. ..... 164/113; 164/131; 164/312

[58] Field of Search ..... 164/131, 113, 137, 303, 164/312, 339-342

[56] References Cited

U.S. PATENT DOCUMENTS 3,672,437 6/1972 Bennett ..... 164/303

*Primary Examiner*—Kuang Y. Lin

*Attorney, Agent, or Firm*—Andrus, Sceales, Starke & Sawall

[57] ABSTRACT

A die casting method using a die casting machine having a fixed die, a movable die and an injection mechanism includes the following steps (a) through (d) of: (a) clamping the movable die to the fixed die; (b) injecting by the injection mechanism the molten metal formed of alloy material into a cavity while the fixed die and the movable die are being clamped to each other; (c) separating the movable die from the fixed die before the alloy material is completely coagulated and shrunken in the cavity; and (d) taking out a product formed of the alloy material from either the movable die or the fixed die after the movable die has been separated from the fixed die.

5 Claims, 13 Drawing Sheets

DIE CASTING METHOD AND DIE CASTING MACHINE

BACKGROUND OF THE INVENTION

The present invention generally relates to a die casting method and machine, and more particularly to a die casting method and machine in which products each having a complex shape can be accurately and effectively cast in aluminum alloy or the like.

Aluminum alloy, magnesium alloy or the like is cast by a die casting machine as shown in FIGS. 1A through 1D. This die casting machine has a fixed die 111 and a movable die 112. A cavity 119 and a runner 121 are formed between the surfaces of the fixed die 111 and the movable die 112 when the fixed die 111 and the movable die 112 are connected to each other. The cavity 119 has a shape corresponding to a product. Molten metal flows through the runner 121 to the cavity 119. A core 115 is provided in the movable die 112 so as to be capable of moving forward and backward with respect to the cavity 119. The fixed die 111 is provided with a sleeve 113. A plunger 114 is provided in the sleeve 113 so as to extrude the molten metal 117 from the sleeve 113 and inject it into the cavity 119. The movable die 112 is provided with a rapping bar 116 for pushing out the product from the movable die 112.

The above die casting machine casts aluminum alloy, in general, in accordance with a procedure shown in FIGS. 1A through 1D.

(1) CLAMPING DIES

The movable die 112 is brought into contact with the fixed die 111, as shown in FIG. 1A, and then the movable die 112 and the fixed die 111 are clamped together at a predetermined clamping pressure.

(2) SUPPLYING MOLTEN METAL

After the above clamping dies process is completed, molten metal 117 formed of an aluminum alloy or the like is supplied to the sleeve 113.

(3) INJECTION

Next, the molten metal 117 is extruded by the plunger 114 from the sleeve 113 and injected via the runner 121 and a gate 118 into the cavity 119 formed between the dies 111 and 112 which are clamped together, as shown in FIG. 1B. The plunger 114 injects the molten metal 117 into the dies 111 and 112 at a predetermined injection pressure and a predetermined injection speed.

(4) SEPARATING DIES

After the plunger 114 presses the molten metal 117 at the predetermined pressure for a predetermined time, the movable die 112 moves backward so as to be separated from the fixed die 111, as shown in FIG. 1C. At this time, the core 115 is pulled out from the cavity 119.

(5) TAKING OUT PRODUCT

After the above separating dies process is completed, the rapping bar 116 is projected from the surface of the movable die 112, so that a product 120 formed of an aluminum alloy is separated from the movable die 112.

In a conventional die casting method, to prevent bubbles from mixing in the product 120 (a faulty filling), the injection speed and the injection pressure at which the molten metal 117 is injected by the plunger 114 are respectively set as great as possible. In addition, after the molten metal 117 in the cavity has been completely coagulated and the alloy material has been completely shrunken, the movable die 112 is separated from the fixed die 111. Thus, in the conventional die casting machine, to completely coagulate the molten metal 117 in the cavity 119 as rapidly as possible, the fixed die 111 and the movable die 112 are respectively cooled by water or the like.

In the conventional die casting method, the aluminum alloy or the like is cast under a condition in which the injection speed and the injection pressure are respectively great, and after the alloy material is completely coagulated and shrunken in the dies, the movable die 112 is separated from the fixed die 111. Thus, when the movable die 112 is separated from the fixed die 111, the product (the cast good) is strongly adhering to the surfaces of the dies. As a result, to separate the movable die 112 from the fixed die 111 without deformation of the product and to smoothly take out the product from the die, it is required to form a draft angle on each die in the conventional die casting machine. For example, in a case where a pipe shaped product having an outer diameter 27 mm, an inner diameter 24 mm and a length 22 mm is cast by the die casting machine, at least a draft 0.5 with respect to the length $l=20$ mm is required.

In the conventional die casting method and die casting machine, as a draft angle is formed on each die, after the product is taken out from the dies, a part of the product corresponding to the draft angle of the dies must be cut. Thus, the number of steps for manufacturing the product increases.

In addition, as the product which is strongly adhered to the surface of the die must be taken out from either of the dies without deformation thereof, it is difficult to manufacture thin products and products each having a complex shape. Further, as the die casting is carried out under a condition in which the injection speed and the injection pressure are respectively great, galling, deformation and the like are easily generated in the product.

SUMMARY OF THE INVENTION

Accordingly, a general object of the present invention is to provide novel and useful die casting method and die casting machine in which the disadvantages of the aforementioned prior art are eliminated.

A more specific object of the present invention is to provide a die casting method and a die casting machine in which products can be accurately cast without performing a step in which products are cut after the casting has been carried out.

The above objects of the present invention are achieved by a die casting method using a die casting machine including a fixed die, a movable die which can be brought into contact with the fixed die and separated therefrom, and an injection mechanism which injects molten metal formed of an alloy material into a cavity formed between the fixed die and the movable die when the movable die is brought into contact with the fixed die and the fixed die and the movable die are clamped to each other, the die casting method comprising the following steps (a) through (d) of: (a) clamping the movable die to the fixed die; (b) injecting by the injection mechanism the molten metal into the cavity while the fixed die and the movable die are being clamped to each other; (c) separating the movable die from the fixed die before the alloy material is completely coagulated and shrunken in the cavity; and (d) taking out a product formed of the alloy material from either the movable die or the fixed die after the movable die has been separated from the fixed die.

The above objects of the present invention are also achieved by a die casting machine comprising: a fixed die; a movable die which can be brought into contact with the fixed die and separated therefrom; an injection mechanism for injecting molten metal formed of an alloy material into a cavity formed between the fixed die and the movable die when the movable die is in contact with and clamped to the fixed die; temperature control means for maintaining a temperature of the fixed die and the movable die at a predetermined temperature; reducing pressure means for reducing pressure in the cavity while the injection mechanism is injecting the molten metal into the cavity; wherein a surface of the cavity formed on the fixed die and the movable die has a portion in which a draft angle is substantially equal to "0", and wherein the movable die is separated from the fixed die before the alloy material filling the cavity is completely coagulated and shrunken.

Additional objects, features and advantages of the present invention will become apparent from the following detailed description when read in conjunction with the accompanying drawings.

DESCRIPTION OF THE PREFERRED EMBODIMENT

A description will now be given of an embodiment of the present invention with reference to the accompanying drawings.

Figure 1B:
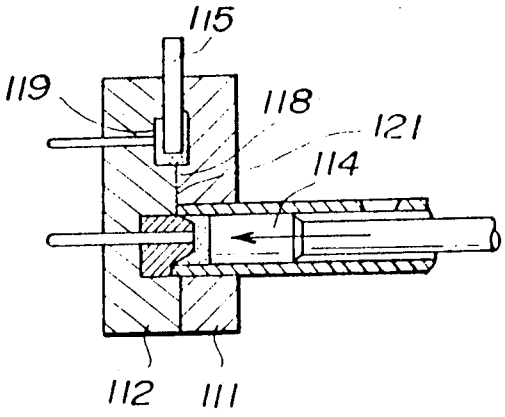
FIG. 1B (PRIOR ART)
FIGS. 1A through 1D are diagrams illustrating a general die casting method.
Figure 1A:
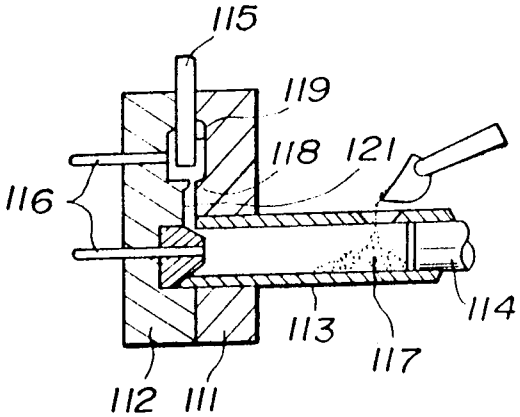
FIG. 1A (PRIOR ART)
Figure 1D:
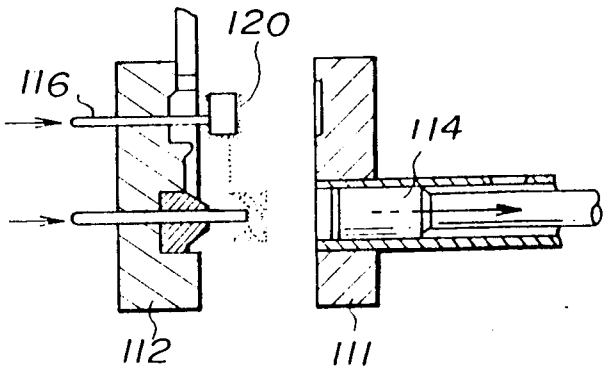
FIG. 1D (PRIOR ART)
Figure 1C:
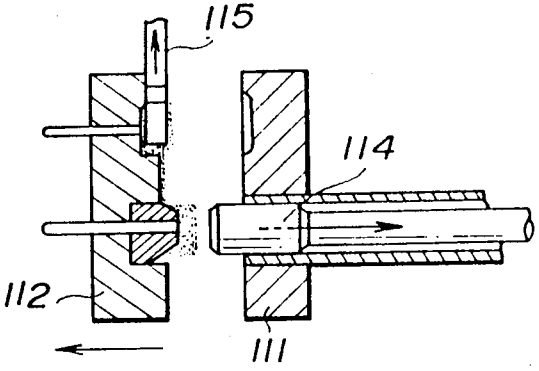
FIG. 1C (PRIOR ART)
Figure 2:
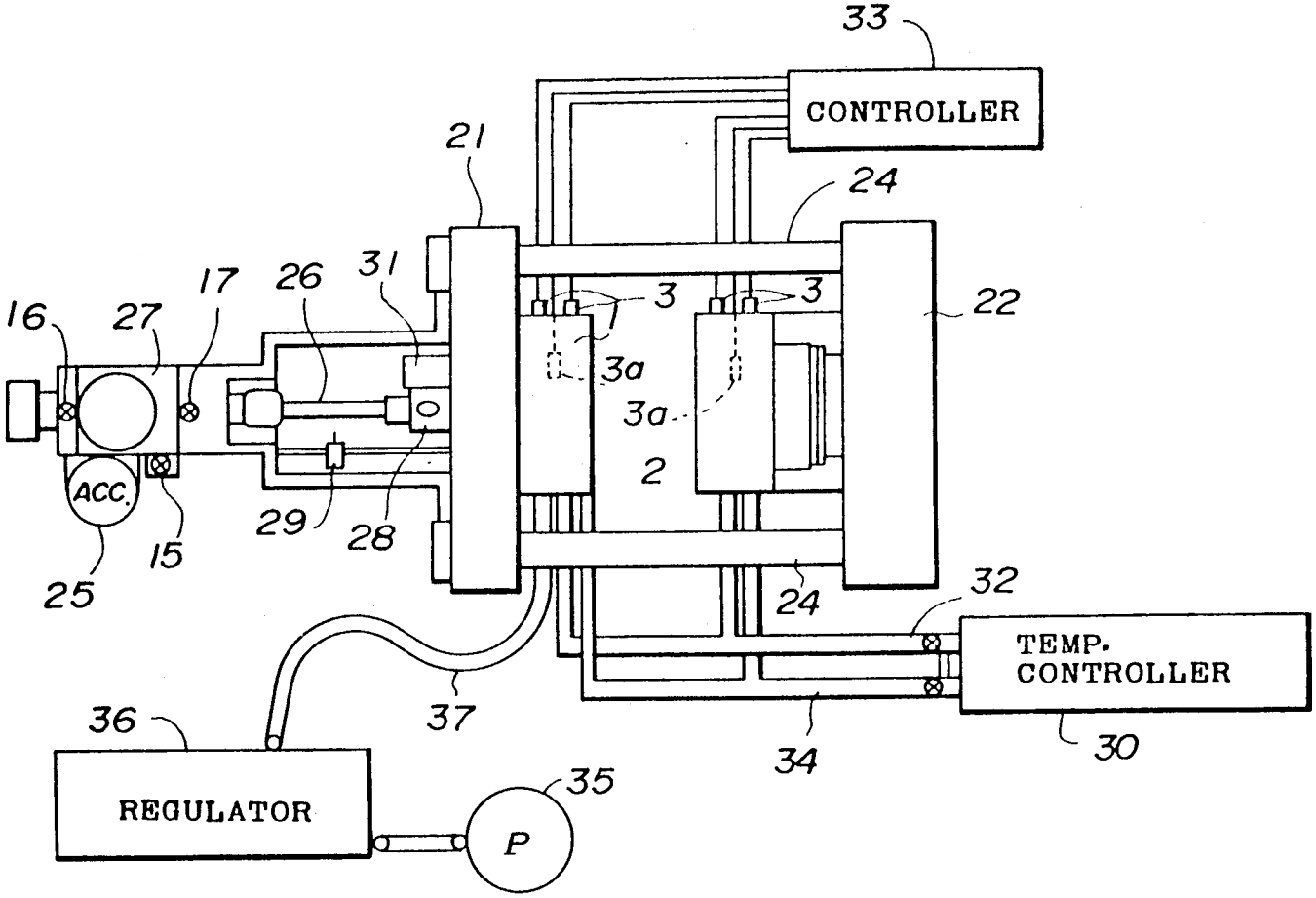
FIG. 2 is a diagram illustrating a die casting machine according to an embodiment of the present invention.

FIG. 2 shows a basic structure of the die casting machine according to an embodiment of the present invention. Referring to FIG. 2, a first die 1 is mounted via a heat insulator on a fixed plate 21, and a second die 2 is mounted on a movable plate 22. The fixed plate 21 and the movable plate 22 are coupled by supporting bars 24 to each other. The movable plate 21 can slide on the supporting bars 24. That is, the second die 2 moves in a direction parallel to the supporting bars 24 together with the movable plate 22. Hereinafter, the first die 1 is referred to as a fixed die 1, and the second die 2 is referred to as a movable die 2.

A sleeve 28 is provided with a heater 31 which heats the sleeve 28. The sleeve 28, which is used for suppling molten metal to the dies, is mounted on a surface of the fixed plate 21 opposite to a surface on which the fixed die 1 is mounted. The sleeve 28 is connected via the fixed plate 21 to the surface of the fixed die 1. A hydraulic cylinder 27 is also mounted on the fixed plate 21. A plunger 26 which is moved forward and backward by the hydraulic cylinder 26 is slidably engaged with the sleeve 28. The hydraulic cylinder 26 is provided with an accumulator 25 which supplies oil pressure to the hydraulic cylinder 26. The hydraulic cylinder 26 is also provided with a high speed valve 16, a low speed valve 17, and a control valve 15. A limit switch 29 is provided adjacent to the plunger 26. When the plunger 26 reaches a predetermined point, the limit switch 29 is turned on so that the injection speed is switched from a low speed to a high speed.

A regulator 36 in which pressure is maintained at a predetermined low pressure by a vacuum pump 35 is connected by a hose 37 to the fixed die 1. Thus, a pressure in a cavity, which is formed between the surfaces of the fixed and movable dies 1 and 2 when the movable die 2 and the fixed die 1 are clamped together and corresponds to a product, is decreased. An oil supplying hose 32 couples a temperature controller 30 to the dies 1 and 2. Oil flows out from the temperature controller 30 via the oil supplying hose 32 to the fixed die 1 and the movable die 2. An oil returning hose 34 is also connected between the temperature controller 30 and dies 1 and 2. The oil supplied to the fixed die 1 and movable die 2 is returned via the oil returning hose 34 to the temperature controller 30. Oil flow paths through which the oil passes are formed in the fixed die 1 and the movable die 2. The above oil supplying hose 32 and the oil returning hose 34 are respectively connected to the oil flow paths formed in the fixed die 1 and the movable die 2. The oil supplied from the temperature controller 30 is circulated in the fixed die 1 and the movable die 2 so that temperatures of the fixed die 1 and the movable die 3 are controlled. In addition, heaters 3 and sensors **3*a* are mounted in both the fixed die 1 and the movable die 2. A controller 33 controls the heaters 3 based on detection signals output from the sensors 3*a* so as to control the temperatures of the fixed die 1 and the movable die 2. The temperatures of the fixed die 1 and the movable die 2 are approximately controlled by the temperature controller 30 and are precisely controlled by the controller 33. Due to the temperature controller 30 and the controller 33**, the temperatures of the fixed die 1 and the movable die 2 are accurately maintained at predetermined temperatures. The temperatures of the fixed die 1 and the movable die 2 are controlled, for example, to within a range of ±5° C.

Figure 3B:
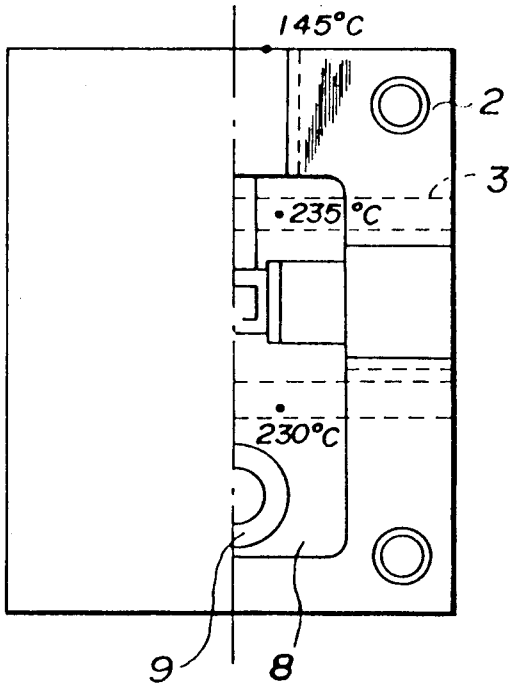
FIGS. 3A and 3B are diagrams illustrating examples of temperature distributions on a fixed die and a movable die in a die casting machine according to the present invention.
Figure 3A:
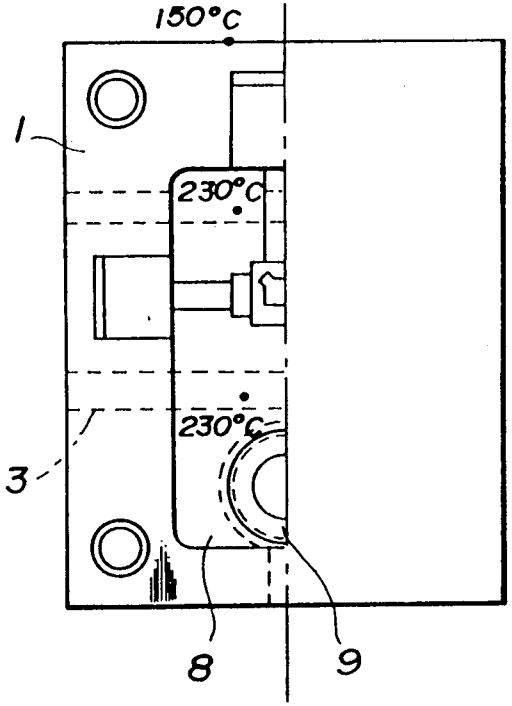
Figure 4B:
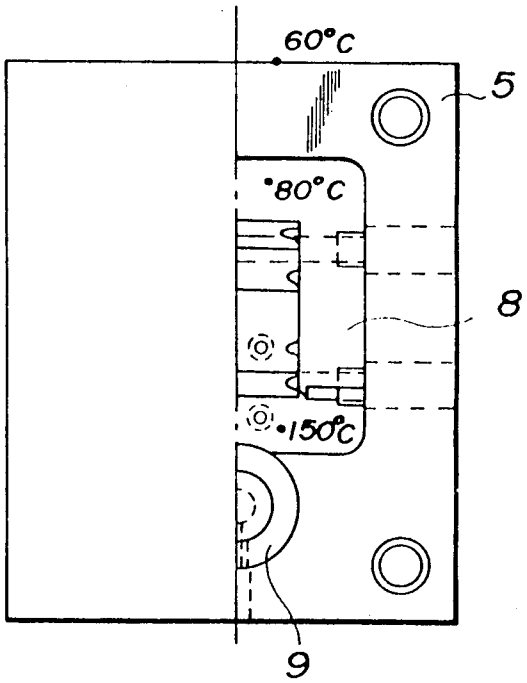
FIG.4B (PRIOR ART)
FIGS. 4A and 4B are diagrams illustrating examples of temperature distributions on a fixed die and a movable die in a conventional die casting machine.
Figure 4A:
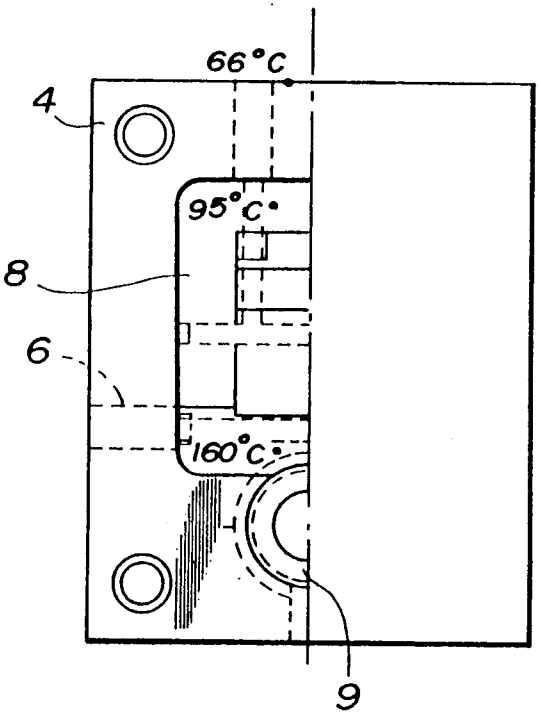
FIG.4A (PRIOR ART)

In the die casting machine having the above described structure, the heaters 3 are mounted in the fixed die 1 and the movable die 2, as shown in FIGS. 3A and 3B. The temperature of the fixed die 1 is controlled by the temperature controller 30 and the controller 33 so that a temperature distribution on the surface of the fixed die 1 is obtained as shown, for example, in FIG. 3A. The temperature of the movable die 2 is also controlled by the temperature controller 30 and the controller 33 so that a temperature distribution on the surface of the movable die 2 is obtained as shown, for example, in FIG. 3B. That is, a peripheral region of each of the dies 1 and 2 is maintained at a temperature of about 150° C. The surface of a cavity 8 of each of the dies 1 and 2 is maintained at a temperature of about 230° C. On the other hand, in the conventional die casting machine, a cooling path 6 in which cooling water is circulated is formed in the fixed die 4, as shown in FIG. 4A. The temperature of the surface of the fixed die 4 is controlled as shown, for example, in FIG. 4A, and the temperature of the surface of the movable die 5 is controlled as shown, for example, in FIG. 4B. That is, a peripheral region of each dies 4 and 5 is maintained at a temperature of about 65° C. The surface of the cavity 8 of each dies 4 and 5 is maintained at a temperature falling within a range of about 90° C. through 150° C.

In the die casting machine according to this embodiment, the temperature on the surface of the cavity 8 is controlled so as to be greater by about 60° C.-80° C. than a temperature thereof in the conventional casting machine, as has been described above.

Figure 5A:
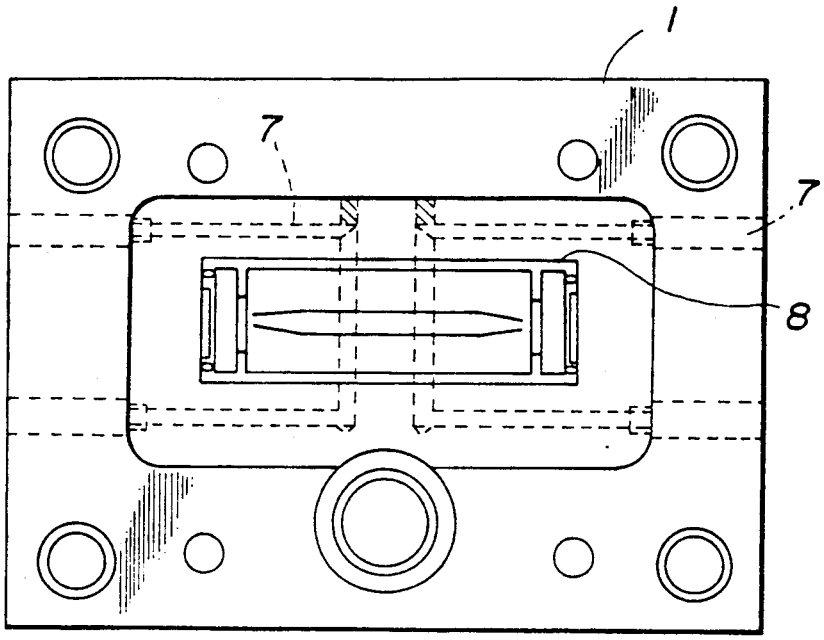
FIG. 5A is a diagram illustrating an oil flow path formed in the movable die in the die casting machine according to the present invention.

In the die casting machine according to this embodiment, an oil flow path 7 is formed adjacent to the cavity 8 in the fixed die 1, as shown in FIG. 5A. The oil flow path 7 is connected to the oil supplying hose 32 and the oil returning hose 34 shown in FIG. 2 so that the oil is circulated in the oil flow path 7. The movable die 2 has approximately the same structure regarding the oil flow path as the fixed die 1.

Figure 5B:
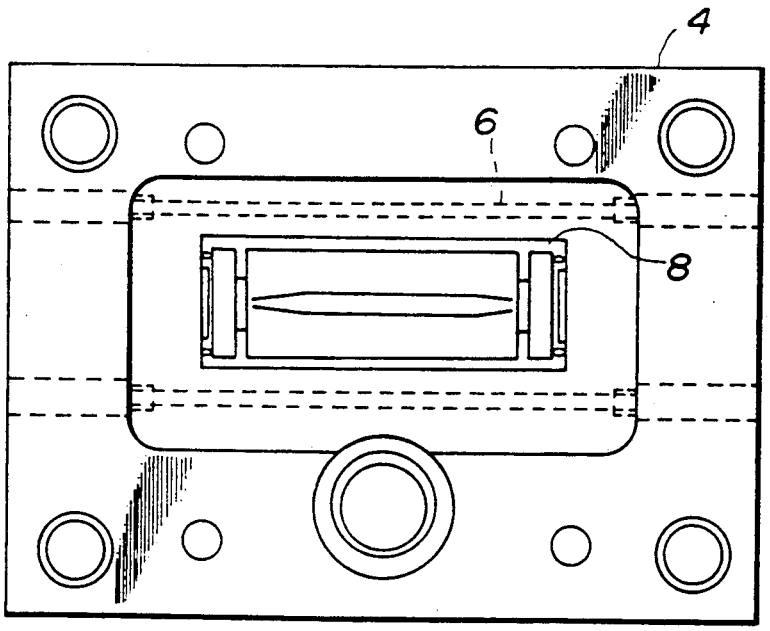
FIG.5B (PRIOR ART)
FIG. 5B is a diagram illustrating an example of a water flow path formed in the movable die in the conventional die casting machine.

On the other hand, in the conventional die casting machine, the cooling water flows in the water flow path 6 formed adjacent to the cavity 8 in the fixed die 4 so that the fixed die 4 is cooled, as shown in FIG. 5B. As a result, the temperature of the fixed die 4 which is heated by the molten metal is controlled so as to be maintained at the temperature described above. In this case, the movable die 5 has approximately the same structure regarding the water flow path as the fixed die 4, as shown in FIG. 5B.

Figure 6A:
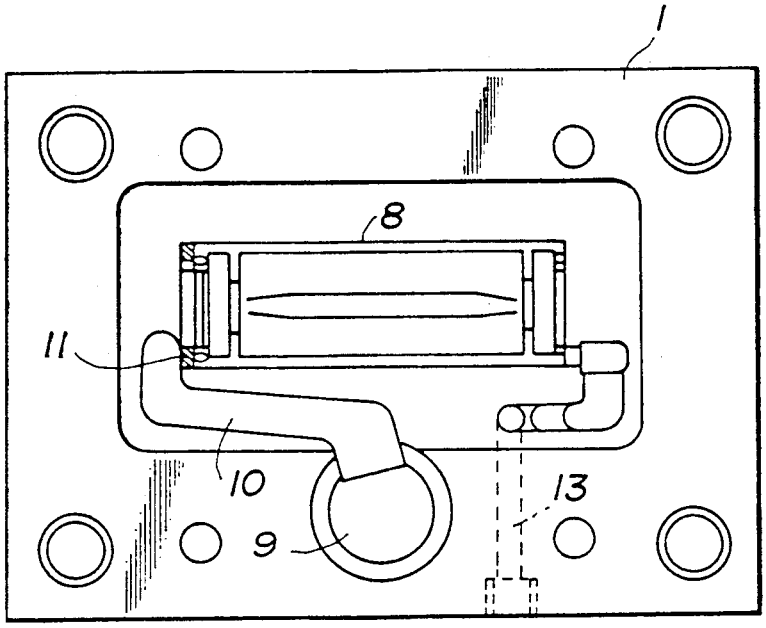
FIGS. 6A and 7A are diagrams illustrating an example of a structure of the fixed die in the die casting machine according to the present invention.
Figure 6B:
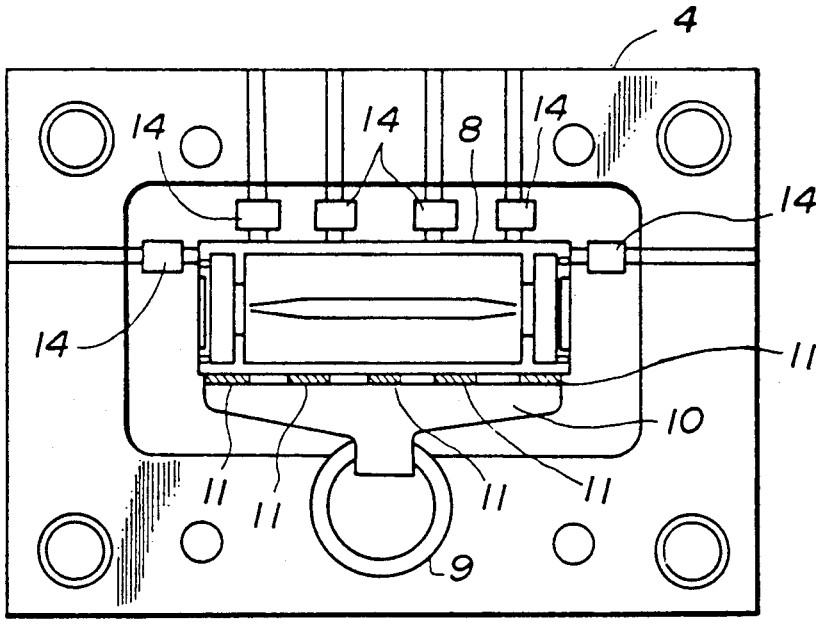
FIG.6B(PRIOR ART)
FIGS. 6B and 7B are diagrams illustrating an example of a structure of the fixed die in the conventional die casting machine.
Figure 7A:
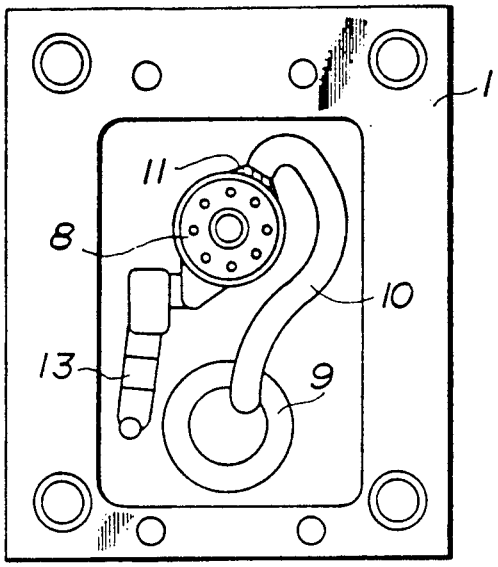
Figure 7B:
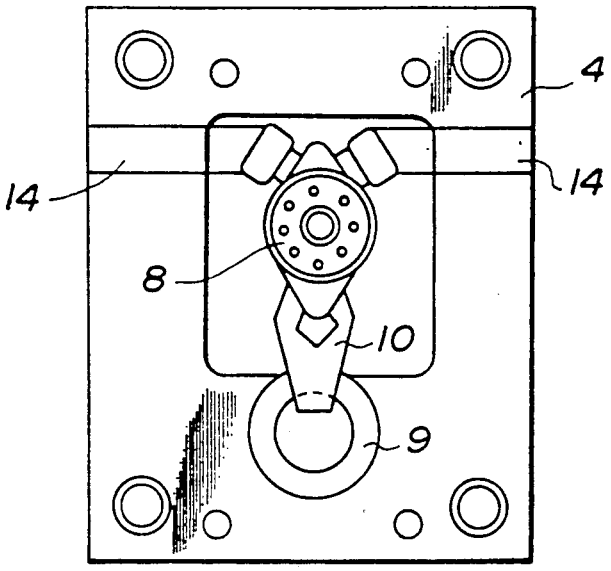
FIG. 7B (PRIOR ART)

Further, in the die casting machine according to this embodiment, a runner 10 connected to a sprue 9 and the cavity 8 is formed on the fixed die 1 (the movable die 2), as shown in FIGS. 6A and 7A, so that the molten metal flowing through the sprue 9 is supplied via the runner 10 and a gate 11 to the cavity 8. In addition, a vacuum path 13 is formed at an end of the cavity 8 opposite to an end at which the gate 11 is provided. The vacuum path 13 is connected to the hose 37 so that the pressure in the cavity 8 is reduced by the vacuum pump 35.

On the other hand, in the conventional die casting machine, a sprue 9, a runner 10 and a gate 11 are formed on the fixed die 4 (the movable die 5), and a plurality of overflow paths 14 which are connected to the cavity 8 are formed thereon. When the molten metal is injected in the cavity 8, air in the cavity 8 passes through the overflow paths 14 and is discharged to the outside of the dies.

As has been described above, in this embodiment, as the pressure in the cavity 8 is reduced, the molten metal can be injected via only a small number of gates into the cavity 8. Further, it is unnecessary to form many overflow paths on each die.

In the die casting method according to the present invention, basic steps including (1) the clamping dies step, (2) the step for supplying the molten metal, (3) the injection step, (4) the separating dies step, and (5) the step for taking out the product are sequentially carried out, in the same manner as in the conventional die casting method. However, the injection step and the molding step in the die casting method according to the present invention differ from those in the conventional die casting method. A variation of the pressure in the molten metal in the injection step is shown in comparison with the conventional variation thereof in FIG. 8.

Figure 8:
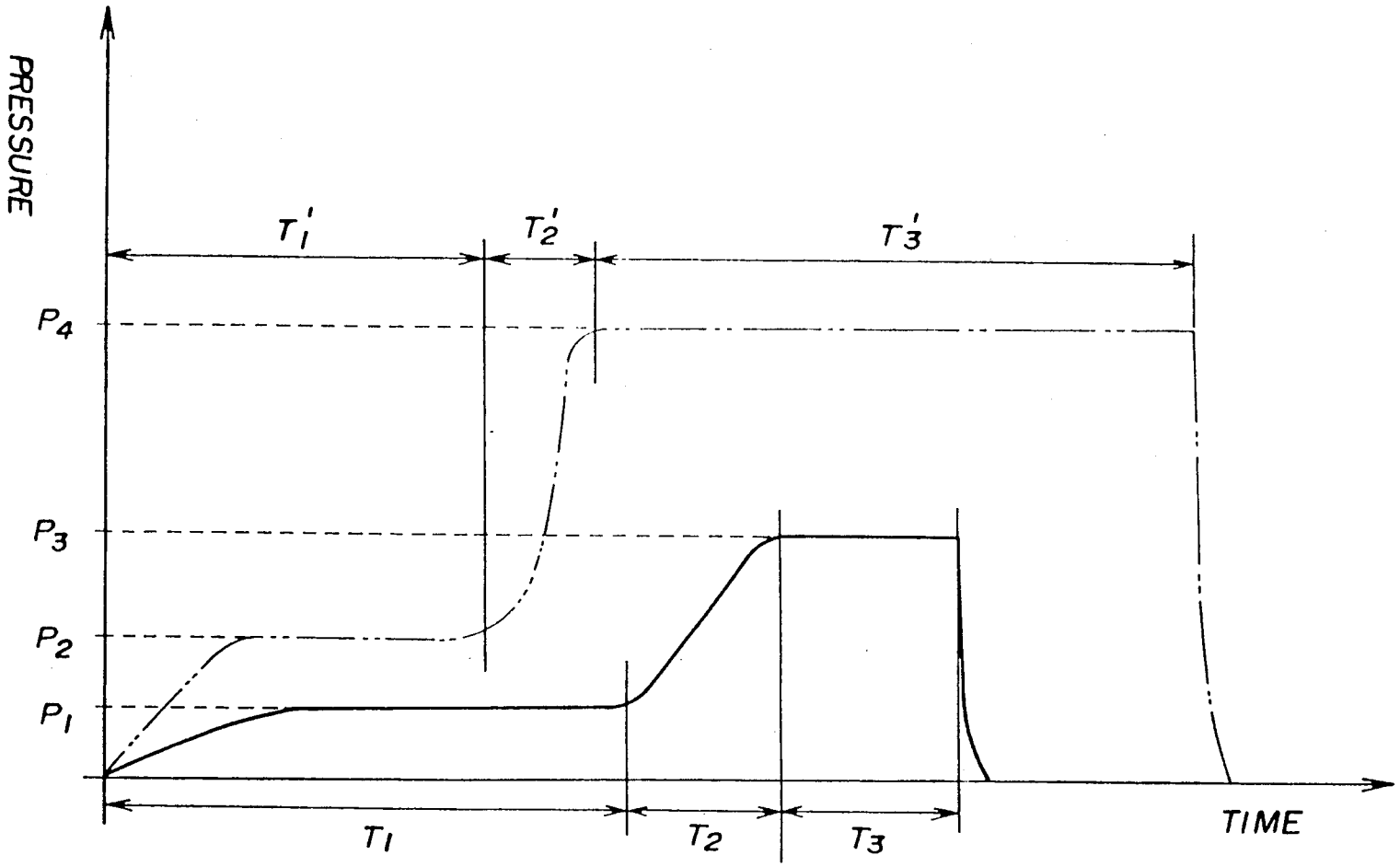
FIG. 8 is a diagram illustrating a variation of an injection pressure in the die casting machine according to the present invention in comparison with a variation of the same in a conventional die casting machine.

Referring to FIG. 8, a characteristic curve of the pressure in the die casting method according to the embodiment of the present invention is illustrated by a continuous line, and a characteristic curve of the pressure in the conventional casting method is illustrated by a chain double-dashed line. In the die casting method according to the embodiment, the injection step is carried out under conditions in which the injection pressure and the injection speed are respectively less than those in the conventional die casting method. Under these conditions, the movable die 2 is separated from the fixed die 1 before the alloy material is completely coagulated and completely shrunken in the cavity. That is, the mold opening step is carried out under a condition in which the product in the cavity is in a semi-coagulation state. The semi-coagulation state is referred to as a state which is obtained before the alloy material is completely coagulated and shrunken in the cavity. In FIG. 8, $T_1$ denotes a period during which a low speed injection is performed, $T_2$ denotes a period during which a high speed injection is performed, $T_3$ denotes a period during which the pressure is maintained. In addition, $T_1'$, $T_2'$ and $T_3'$ respectively denote periods in the conventional die casting method, $T_1'$ corresponding to a period during which the low speed injection is performed, $T_2'$ corresponding to a period during which the high speed injection is performed, and $T_3'$ corresponding a period during which the pressure is maintained. The pressure in the cavity is reduced in the injection step.

As has been described above, in the die casting method according to the embodiment, the sleeve 28 is heated so that the molten metal having a relatively high temperature is supplied to the cavity, and the fixed die 1 and the movable die 2 are controlled at a relatively high temperature. Then, the movable die 2 is separated from the fixed die 1 before the alloy material in the cavity 8 is completely coagulated and completely shrunken. That is, the mold opening step is carried out before the alloy material is strongly adhered to the surface of the cavity. Thus, even if the draft angle of each die is substantially equal to "0", the movable die 2 can be separated from the fixed die 1 without deformation of the product. Further, the product can be easily taken out from the movable die 2.

In addition, as the molten metal is injected into the cavity at a low injection speed and a low injection pressure while the pressure in the cavity is being reduced, the cavity can be filled with the alloy material in such a state that no galling is generated on the product. Thus the separating dies step can also be carried out under a condition in which an adhesive force for adhering the alloy material to the surface of each die is further decreased.

Still further, as the separating dies step is carried out before the alloy material is strongly adhered to the surface of the cavity, a product which is thin and/or has a complex shape can easily be taken out from the movable die 2 without deformation of the product.

The fixed die 1 and the movable die 2 are respectively controlled at a relatively high temperature by the heaters 3 and the temperature controller 30, as shown in FIGS. 2, 3A and 3B. The temperature at which the dies are controlled is determined in accordance with the type of alloy material. For example, in a case where an aluminum alloy is cast, it is desirable that the fixed die 1 and the movable die 2 be controlled at a temperature falling within a range of about 380° C.-150° C. In a case where a magnesium alloy is cast, it is desirable that the dies 1 and 2 be controlled at a temperature falling within a range of about 200° C.-75° C.

In the die casting method according to the present invention, as the separating dies step is carried out before the alloy material is completely coagulated and shrunken, the period of during which the alloy material is maintained in the cavity at a predetermined temperature can be decreased. That is, a period of time starting at the clamping dies step and ending at the separating dies step (a molding time) can be decreased. For example, it is possible to manufacture a product in about 2 seconds, while the same product is manufactured in 5 seconds in accordance with the conventional die casting method.

Figure 9:
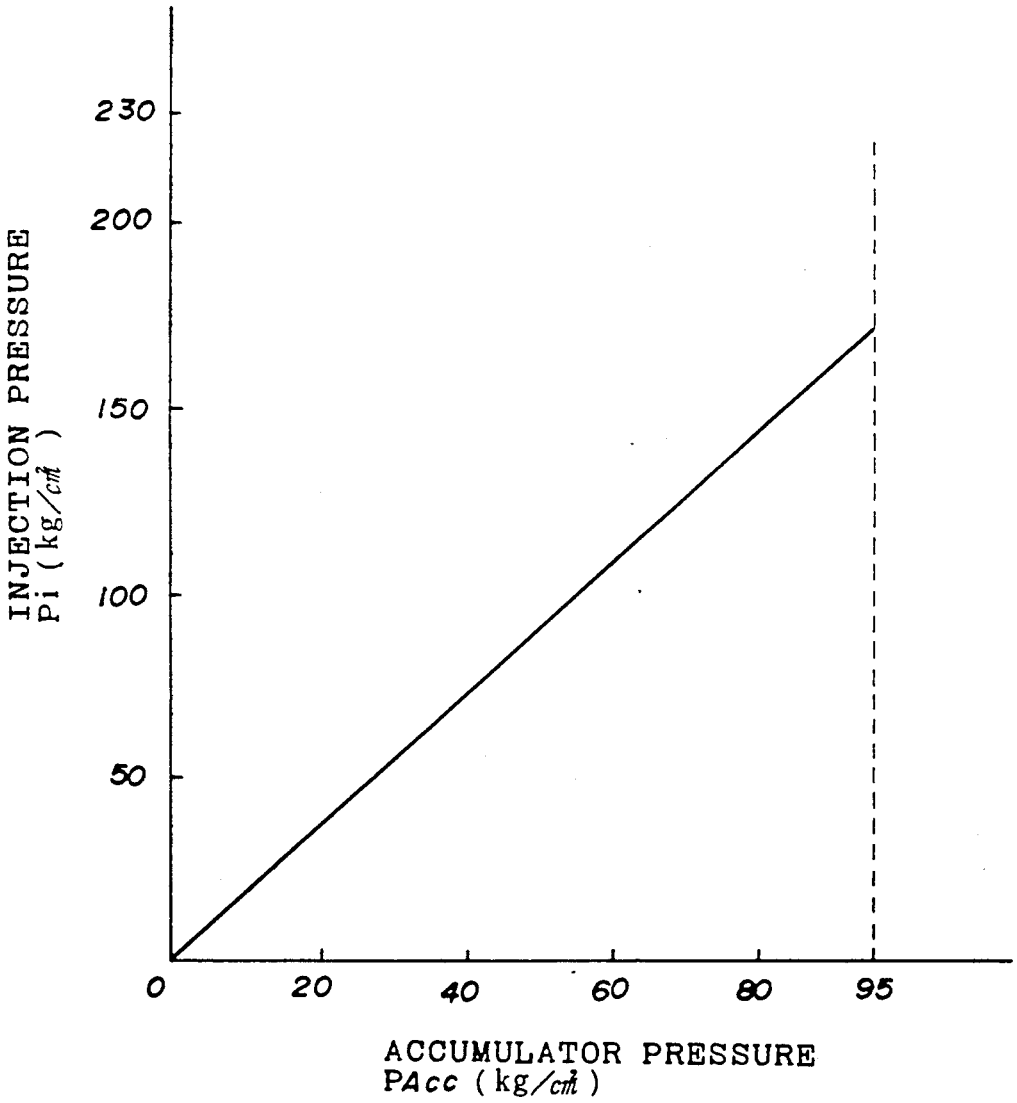
FIG. 9 is a graph illustrating a relationship between a pressure in an accumulator and the injection pressure.

FIG. 9 shows a relationship between the pressure in the accumulator 25 and the injection pressure. An optimum pressure in the accumulator 25 is set in accordance with the graph shown in FIG. 9 so that a predetermined injection pressure is obtained.

Figure 10:
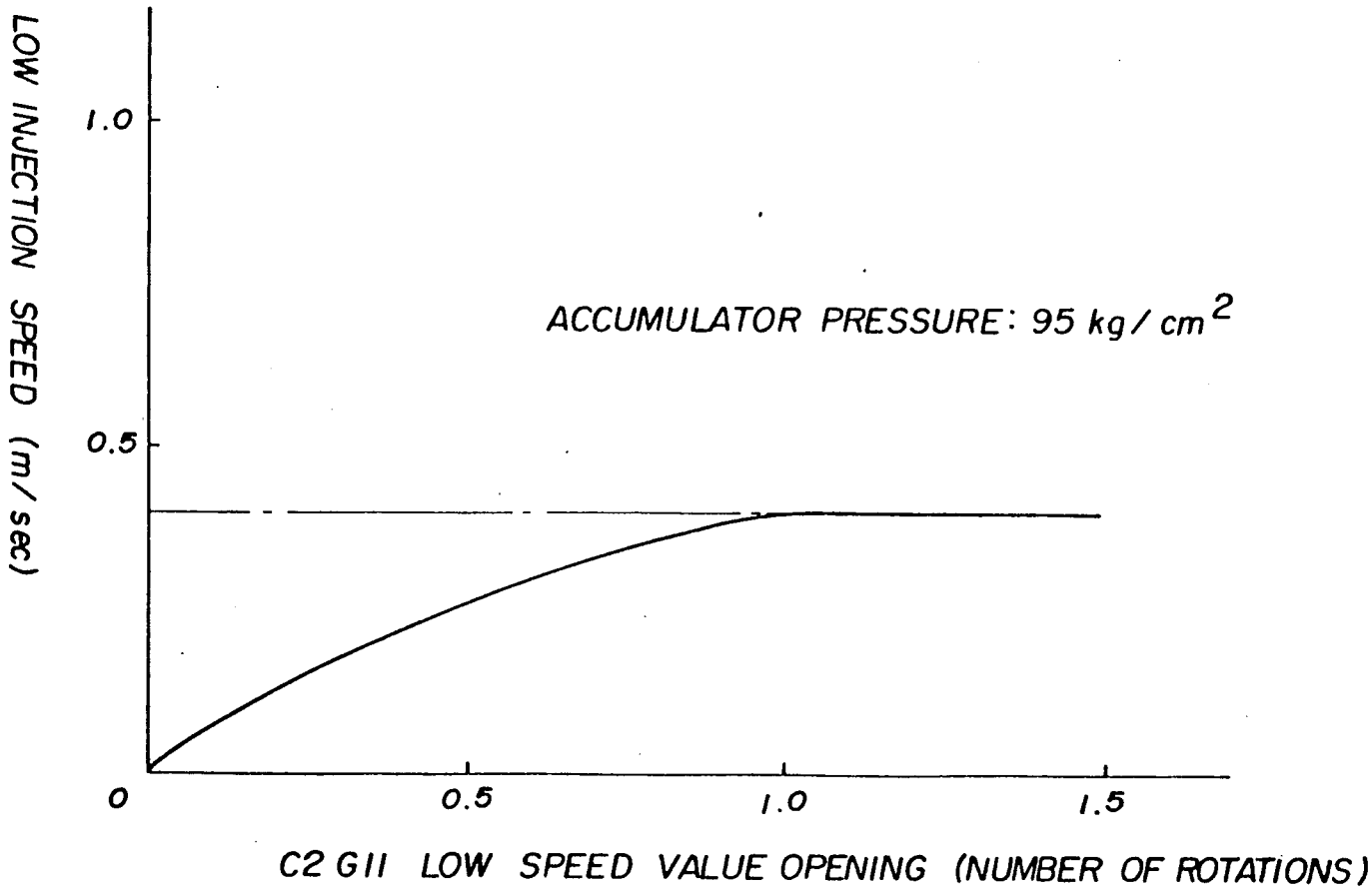
FIG. 10 is a graph illustrating a relationship between a degree of opening of a low speed valve and a low injection speed.

FIG. 10 shows a relationship between the degree of opening of the low speed valve 17 and the low injection speed. The amount of opening of the low speed valve 17 is controlled in accordance with the graph shown in FIG. 10 so that a predetermined low injection speed is obtained. The low injection speed obtained depends on the composition of the alloy material. It is desirable that the low injection speed fall within a range of 0.01-0.4 m/sec.

Figure 11:
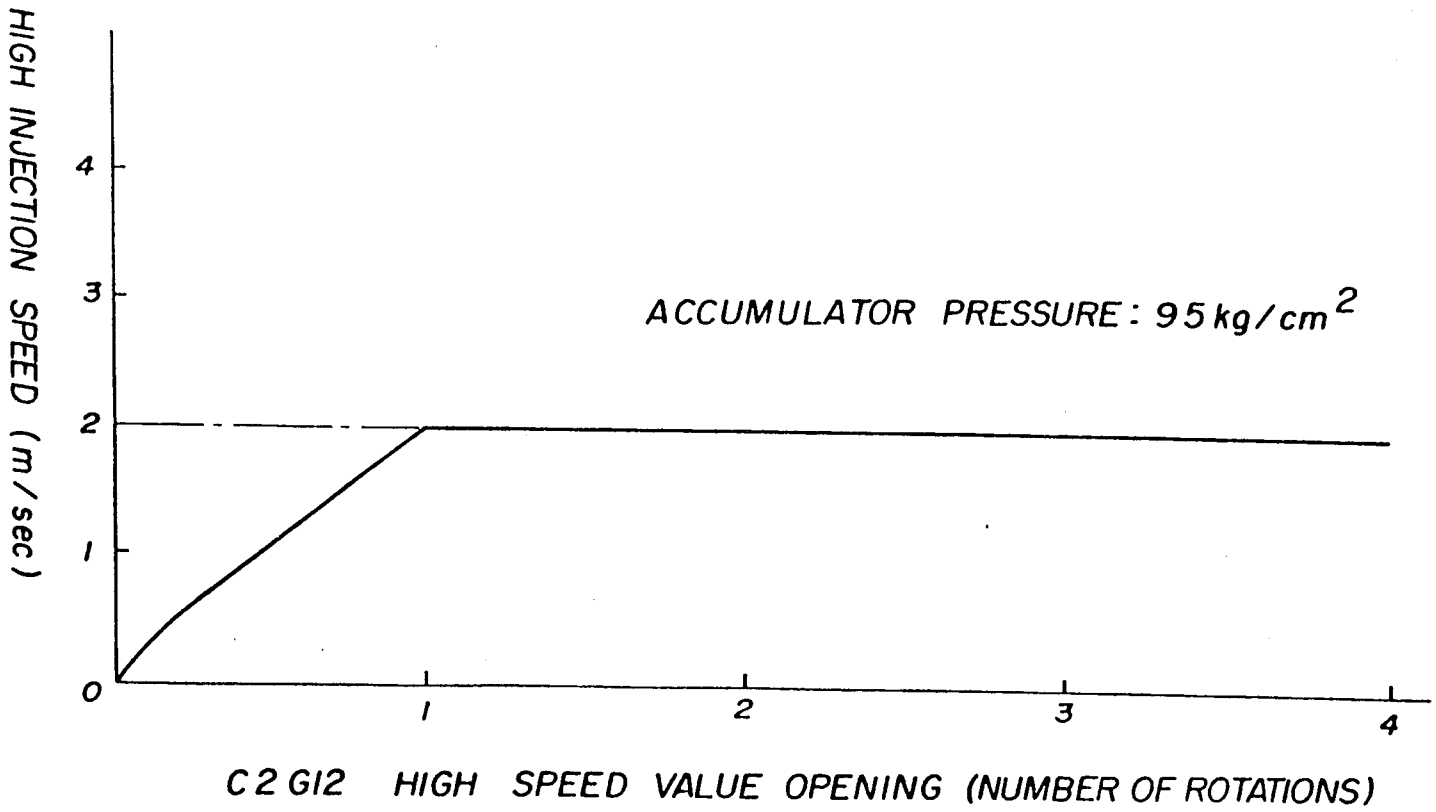
FIG. 11 is a graph illustrating a relationship between a degree of opening of a high speed valve and a high injection speed.

FIG. 11 shows a relationship between the amount of opening of the high speed valve 16 and the high injection speed. The amount of opening of the high speed valve 16 is controlled in accordance with the graph shown in FIG. 11 so that a predetermined high injection speed is obtained. The high injection speed obtained also depends on the composition of the alloy material. It is desirable that the high injection speed fall within a range of 0.01-2 m/sec.

In addition, it is desirable that the injection pressure fall within a range of 110-190 kg/cm$^2$.

Figure 12:
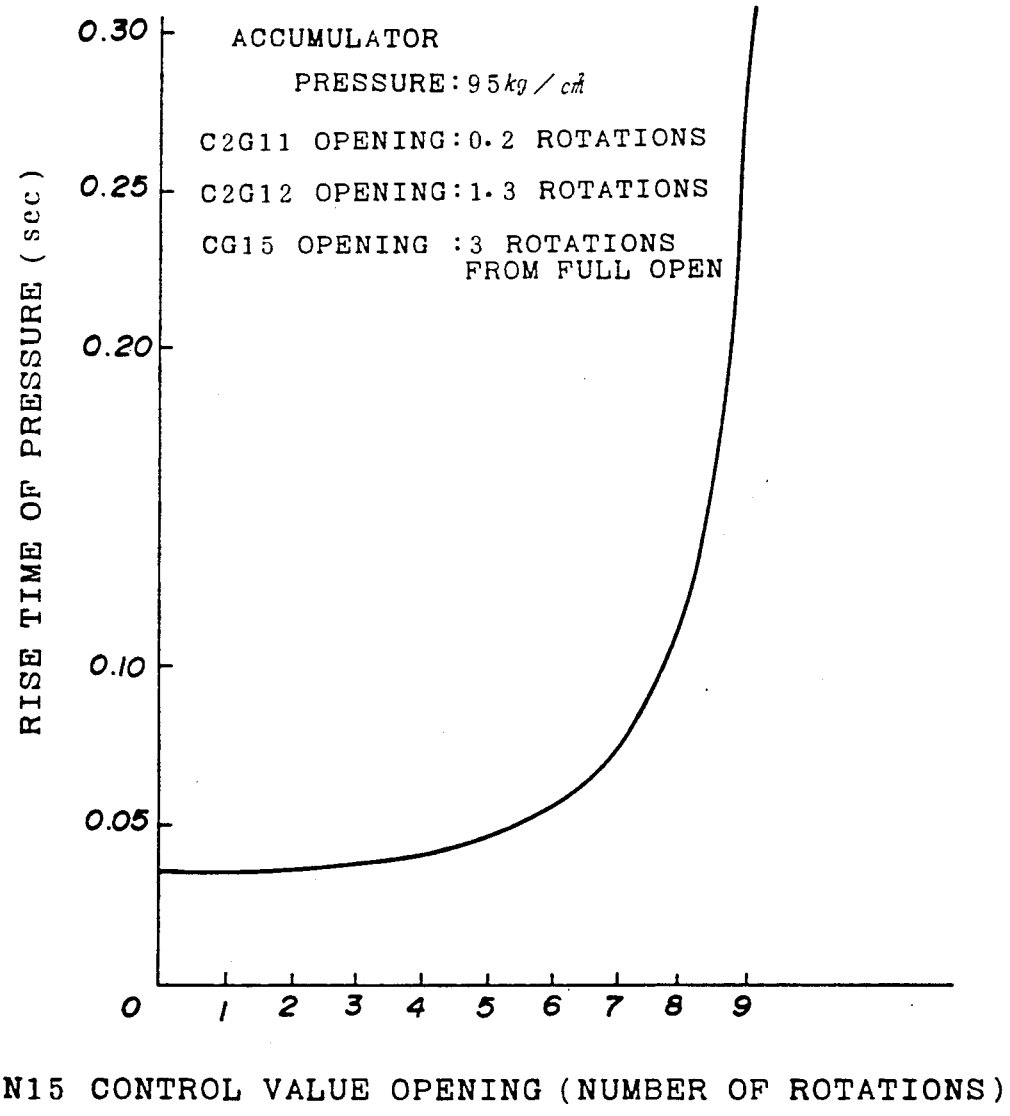
FIG. 12 is a graph illustrating a relationship between a degree of opening of a control valve and a rise time of a pressure.

FIG. 12 shows a relationship between the control valve 15 and the rise time of the injection pressure. Injection method such as an in-contraction method, an out-contraction method, a vertical dies method, an FE-method and so on have been proposed. In the die casting method according to the present invention, the molten metal is injected into the cavity in accordance with the in-contraction method. In this case, the rise time of the injection pressure depends on particular parts of the injection mechanism. The rise time of the injection pressure is controlled by the control valve 15 in accordance with the graph shown in FIG. 12.

A description will now be given of examples and comparison examples.

Figure 13:
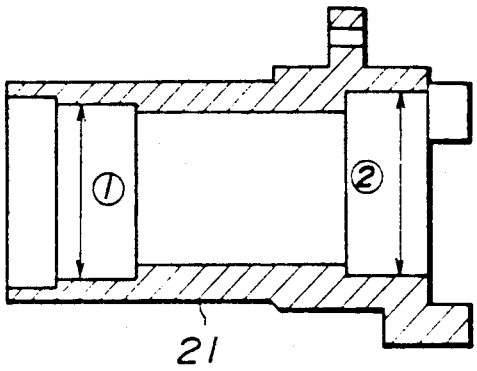
FIGS. 13 through 15 are sectional views showing products manufactured by the die casting method.

A product 21 shown in FIG. 13 was cast in aluminum alloy under conditions in an Example 1 and a Comparison example 1 shown in Table-1.

As shown in Table-1, in Example 1, the injection speed was less than that in Comparison Example 1, and the temperature of the dies Example 1 was about 100° C. higher than that in the Comparison Example 1. In Example 1, the draft angle of each of the dies 1 and 2 was substantially equal to "0", so that no cutting part corresponding to the draft angle was formed on the product 21, and thus the product 21 having a good dimensional accuracy was obtained. In Example 1, as the temperatures of the dies were higher those that in Comparison Example 1 and the pressure in the cavity was reduced, the molten metal could fill up narrow part of the product. Thus, the product 21 having a good appearance was obtained. Further, the molding time was about 3 seconds in Comparison Example 1, but, in Example 1, the molding time was about 1.5 seconds.

TABLE 1

| CASTING CONDITION | EXAMPLE 1 | COMPARISON EXP. 1 |
|---|---|---|
| INJECTION SPEED | | |
| LOW INJ. SPEED | 0.13 m/sec | 0.24 m/sec |
| HIGH INJ. SPEED | 0.85 m/sec | 1.6 m/sec |
| DIES TEMP. | 250° C. ± 5° C. | 150° C. |
| MOLD. TIME | app. 1.5 sec | app. 3 sec |
| SET CONDITION | | |
| DRAFT | | |
| INNER DIA. | ① $Ø13_0^{+0.02}$ × 6 DFT = 0<br>② $Ø13_0^{+0.02}$ × 6 DFT = 0 | $Ø13_0^{+0.02}$ × 6 DFT = 2° 0.19<br>JIS 0.49 |
| OUTER DIA. | $Ø15_{-0.05}^{0}$ × 10 DFT = 0 | $Ø15_{-0.05}^{0}$ × 10 DFT = 30° 0.19<br>JIS 0.86 |
| DIMENSIONAL ACCURACY | | |
| IN. DIA. $Ø13_0^{+0.02}$ | ① Ø13.02-Ø13.015<br>② Ø13.02-Ø13.015 | Ø13 – CUTTING-DRAFT |
| OUT. DIA. $Ø15_{-0.05}^{0}$ | Ø14.98-Ø14.965 | Ø15 – CUTTING-DRAFT |
| CONCENTRICITY | 0.02 | 0.02 (BY CUTTING) |
| APPEARANCE | | |
| RUN CONDITION | FINE (REDUCING PRESSURE, HIGH TEMP. ON DIES) | LOW QUALITY IN RUN CONDITION (INCREASING INJECTION SPEED FUSING, |

TABLE 1-continued

| CASTING CONDITION | EXAMPLE 1 | COMPARISON EXP. 1 |
|---|---|---|
| | | GALLING, DEFORMATION |

Figure 14:
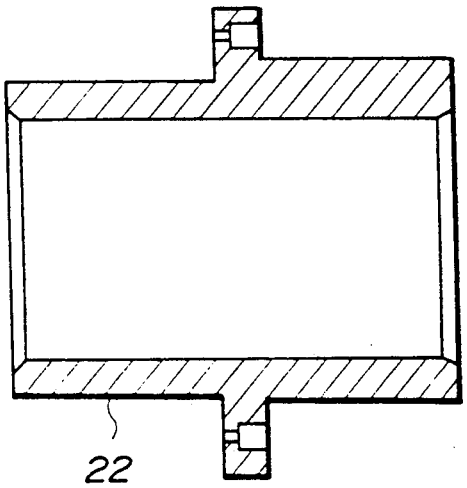
Figure 15:
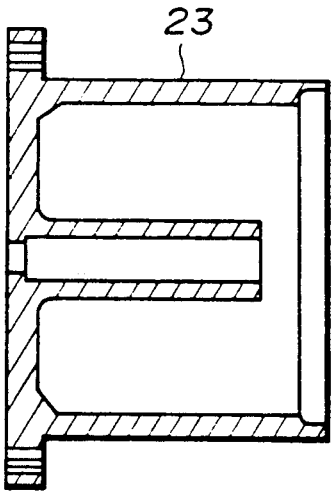

A product 22 shown in FIG. 14 was cast in aluminum alloy under conditions in an Example 2 and a Comparison Example 2 shown in Table-2.

As shown in Table-2, in Example 2, no cast part corresponding to the draft angle of each die was formed on the product 22, and thus the product 22 having a good dimensional accuracy and good appearance was obtained. The molding time was about 5 seconds in Comparison Example 2, but, in Example 2, the molding time was about 2 seconds.

TABLE 2

| CASTING CONDITION | EXAMPLE 2 | COMPARISON EXP. 2 |
|---|---|---|
| INJECTION SPEED | | |
| LOW INJ. SPEED | 0.18 m/sec | 0.37 m/sec |
| HIGH INJ. SPEED | 1.25 m/sec | 2.65 m/sec |
| DIES TEMP | 240° C. ± 5° C. | 170° C. |
| MOLD. TIME | app. 2 sec | app. 5 sec |
| SET CONDITION | | |
| DRAFT | | |
| INNER DIA. | $\phi 46_{-0.015}^{+0.031} \cdot 44$ DFT = 0 | $\phi 46 \cdot 44 \cdot$ DFT = 1° 0.76 JIS 2.4 |
| OUTER DIA. | $\phi 50_{-0.054}^{-0.015} \cdot 16$ DFT = 0 | $\phi 50 \cdot 16 \cdot$ DFT = 1° 0.28 JIS 0.9 |
| DIMENSIONAL ACCURACY | | |
| IN. DIA. $\phi 46_{-0.015}^{+0.031}$ | $\phi 46.029$-$\phi 46.017$ | $\phi 46$ − CUTTING-DRAFT |
| OUT. DIA. $\phi 50_{-0.054}^{-0.015}$ | $\phi 49.98$-$\phi 49.956$ | $\phi 50$ + CUTTING-DRAFT |
| CONCENTRICITY | 0.03 | 0.02 (BY CUTTING) |
| APPEARANCE | | |
| RUN CONDITION | FINE | THERE IS FUSING |

A product 23 was cast in aluminum alloy under conditions in an Example 3 and a Comparison Example 3.

As shown in Table-3, in Example 3, no cutting part corresponding to the draft angle of each die was formed on the product 23, and thus the product 23 having a good dimensional accuracy and good appearance was obtained. The molding time was about 3 seconds in Comparison Example 3, but, in Example 3, the molding time was about 1.5 seconds.

TABLE 3

| CASTING CONDITION | EXAMPLE 3 | COMPARISON EXP. 3 |
|---|---|---|
| INJECTION SPEED | | |
| LOW INJ. SPEED | 0.15 m/sec | 0.32 m/sec |
| HIGH INJ. SPEED | 0.8 m/sec | 1.5 m/sec |
| DIES TEMP. | 250° C. ± 5° C. | 150° C. |
| MOLD. TIME | app. 1.5 sec | app. 3 sec |
| SET CONDITION | | |
| DRAFT | | |
| INNER DIA. | $\phi 8_0^{+0.02} \cdot 18$ DFT = 0 | $\phi 8_0^{+0.02} \times 18$ DFT = 1° 0.16 JIS 1.5 |
| OUTER DIA. | $\phi 36_0^{+0.05} \cdot 18.6$ DFT = 0 | $\phi 36_0^{+0.05} \times 18$ DFT = 1° 0.32 JIS 1.55 |
| DIMENSIONAL ACCURACY | | |
| IN. DIA. $\phi 8_0^{+0.02}$ | $\phi 8.02$-$\phi 8.017$ | $\phi 13$ − CUTTING-DRAFT |
| OUT. DIA. $\phi 36_0^{+0.05}$ | $\phi 36.05$-$\phi 36.04$ | $\phi 15$ + CUTTING-DRAFT |
| CONCENTRICITY | 0.02 | 0.02 (BY CUTTING) |
| APPEARANCE | | |
| RUN CONDITION | FINE (REDUCING PRESSURE, HIGH TEMP. ON DIES) | LOW QUALITY IN RUN CONDITION (INCREASING INJECTION SPEED FUSING, GALLING, DEFORMATION |

In the die casting machine according to the present invention, it is not necessary for the draft angle to be substantially equal to "0" at all parts on the fixed die 1 and the movable die 2. The draft angle can also be substantially equal to "0" at only those parts which are required to be manufactured accurately.

The present invention is not limited to the aforementioned embodiments, and variations and modifications may be made without departing from the scope of the claimed invention.

What is claimed is:

1. A die casting method using a die casting machine including a fixed die, a movable die which can be brought into contact with said fixed die and be separated therefrom, and an injection mechanism which injects molten metal formed of an alloy material into a cavity formed between said fixed die and the movable die when said movable die is brought into contact with said fixed die and said fixed die and said movable die are clamped to each other, said die casting method comprising the following steps (a) through (d) of:

(a) clamping said movable die to said fixed die;

(b) injecting by said injection mechanism the molten metal into the cavity while said fixed die and said movable die are clamped to each other;

(c) separating said movable die from said fixed die before the alloy material is completely coagulated and shrunken in the cavity; and (d) taking out a product formed of the alloy material from either said movable die or said fixed die after the movable die has been separated from said fixed die.

2. A die casting method as claimed in claim 1, further comprising a step of reducing pressure in the cavity while the molten metal is being injected into the cavity in said step (b).

3. A die casting machine comprising:

a fixed die;

a movable die which can be brought into contact with said fixed die and separated therefrom;

an injection mechanism for injecting molten metal formed of an alloy material into a cavity formed between said fixed die and said movable die when said movable die is in contact with said fixed die and clamped to said fixed die;

temperature control means for maintaining a temperature of said fixed die and said movable die at a predetermined temperature;

pressure reducing means for reducing pressure in said cavity while said injection mechanism is injecting the molten metal into said cavity;

wherein a surface of the cavity formed between said fixed die and said movable die has a portion in which a draft angle is substantially equal to "0", and wherein said movable die is separated from said fixed die before the alloy material filling the cavity is completely coagulated and shrunken.

4. A die casting machine as claimed in claim 3, wherein said injection mechanism comprises a sleeve which is connected to said fixed die, the molten metal being supplied to said sleeve, an extrusion mechanism for extruding the molten metal from said sleeve to said fixed die and said movable die, and heating means for heating said sleeve.

5. A die casting machine as claimed in claim 3, wherein said temperature control means comprises first temperature control means for supplying oil which is heated at a predetermined temperature to an oil flow path formed in said fixed die and said movable die, the oil being circulated in the oil flow path, and second temperature control means for controlling the temperature of said fixed die and said movable die, said second temperature control means including heaters provided in said fixed die and said movable die and a heater controller which controls said heaters in accordance with the temperature of said fixed die and said movable die.

* * * * *